US006129484A

United States Patent [19]

Chiaves

[11] Patent Number: 6,129,484

[45] Date of Patent: Oct. 10, 2000

[54] PREFABRICATED STRUCTURE FOR THE CONSTRUCTION OF OVERHEAD OR UNDERGROUND WORKS

[76] Inventor: Carlo Chiaves, Corso Govone 10, I-10129 Turin, Italy

[21] Appl. No.: 09/068,647

[22] PCT Filed: Nov. 17, 1996

[86] PCT No.: PCT/EP96/04989

§ 371 Date: May 12, 1998

§ 102(e) Date: May 12, 1998

[87] PCT Pub. No.: WO97/19231

PCT Pub. Date: May 29, 1997

[30] Foreign Application Priority Data

Nov. 17, 1995 [IT] Italy ..... TO95A0922

[51] Int. Cl.[7] ..... F02D 29/045

[52] U.S. Cl. ..... 405/134; 405/126

[58] Field of Search ..... 405/134, 124, 405/151, 125, 126, 150, 152, 153

[56] References Cited

U.S. PATENT DOCUMENTS

| | | | |
|---|---|---|---|
| 4,290,246 | 9/1981 | Hilsey | 52/169.1 |
| 4,693,634 | 9/1987 | Chiaves | 405/126 |
| 4,693,635 | 9/1987 | Matiere | 405/132 |
| 4,836,714 | 6/1989 | Matiere | 405/134 |
| 4,983,070 | 1/1991 | Hwang | 405/124 |
| 5,118,218 | 6/1992 | Musser et al. | 405/124 |
| 5,180,254 | 1/1993 | Matiere | 405/155 |

FOREIGN PATENT DOCUMENTS

| | | |
|---|---|---|
| 2230813 | 12/1974 | France . |
| 2547607 | 12/1984 | France . |
| WO8505653 | 12/1985 | WIPO . |

*Primary Examiner*—Eileen D. Lillis
*Assistant Examiner*—Frederick L. Lagman
*Attorney, Agent, or Firm*—Sughrue, Mion, Zinn, Macpeak & Seas, PLLC

[57] ABSTRACT

A prefabricated structure for the construction of open air structures, particularly motorway flyovers, underpasses, bridges, tunnels, underground carparks and the like, includes a plurality of prefabricated elements of reinforced concrete. These elements are able to define the side walls and the deck of the work with adjacent longitudinal sections of the structure which rest on a foundation at the base of the work. Each section of the structure includes a pair of side elements which rest on the foundation via a static hinge and are intended to be disposed symmetrically with respect to the axle of the structure so as to assume a substantially L-shaped configuration. A substantially rectilinear prefabricated element is interposed centrally between two side elements and is anchored thereto so as to define a central portion of the deck of the work.

11 Claims, 4 Drawing Sheets

PREFABRICATED STRUCTURE FOR THE CONSTRUCTION OF OVERHEAD OR UNDERGROUND WORKS

BACKGROUND OF THE INVENTION

The present invention concerns works such as motorway flyovers, underpasses, bridges, artificial tunnels, underground garages or carparks and other similar works that are constructed in the open air, that is, on a substantially level area which may be obtained following excavation below ground level before building the structure.

Various technical solutions are known for undertaking such works. In particular, prefabricated reinforced concrete articulated elements of, for example, the type described in European Patent EP-0 219 501, are widely used for this purpose.

Specifically, the prefabricated articulated elements are concrete elements, each being formed from several bodies that are joined together only by the reinforcement rods common to two adjoining bodies. These elements are produced in an extended, coplanar condition and, in this condition, they are more easily transported to the construction site. During installation, they are lifted using suitable slings in such a way that, due to the weight, the reinforcement rods bend at the predetermined articulation points between the various bodies such that each element automatically assumes its final configuration. Once installation is complete, the articulation points are fixed with cast sealing concrete and possible additional reinforcements incorporated in the joint between adjoining bodies. In these prefabricated articulated structures the continuity of the reinforcement in all of the tensioned parts in the finished structure, the exact arrangement of the reinforcements in use, and the simple and quick operations for installing the structure are guaranteed.

The prefabricated articulated elements are normally used in two different types of structure, in particular, closed frame box structures, and arch structures having three hinges.

Prefabricated elements intended for the construction of closed frame box structures each comprise five bodies separated by four articulations. An inverted U-shape structure is obtained upon lifting an element, which defines the two supporting uprights and the roof of the structure, in which the various bodies are disposed at approximately 45° with respect to the adjacent bodies. The two uprights are then anchored in situ at the base by a single concrete casting which joins them together, and the final closed-frame box structure is obtained after sealing the articulations and the joints between the various adjoining prefabricated elements. This type of structure is optimally used for works having spans of approximately 3 to 6 m. In this way, the dimensions of the prefabricated articulated elements are still within the permitted shape limits for transportation by road, whereas prefabricated elements for closed box structures of the same section that are already in their final configuration would fall outside this shape limit.

For the construction of arch structures having three hinges, prefabricated elements are instead used that are joined in pairs to form a central hinge at the contact zone. Each of these prefabricated elements comprises three bodies separated by two hinges and, when installed, assumes the form of a rounded inverted L-shape in which each body forms an angle of substantially 45° with the adjacent bodies. Each element of each pair rests via an associated hinge on an associated continuous foundation plinth cast in situ. The assembly of the two elements thus forms an arch having three hinges: two at the base, between each prefabricated element of the pair and each of the plinths, and a central hinge between the two prefabricated elements. These structures enable larger structures than the closed-frame box structure to be obtained, in practice, having spans of from 5–6 m to approximately 15 m, with the typical characteristic of three-hinge arch structures of being isostatic and therefore not subject to any stress state even if the plinths subside, in which case the entire structure is subject to deformation, but each individual isolated loop comprising a pair of adjoining elements is not as a whole subject to any stresses caused by the subsidence.

In general, in both of the known arrangements described above, the prefabricated elements form a completely stable assembly even before the sealing concrete castings. The assembly of the various prefabricated elements does not require any kind of temporary shoring means, such as underpinning, falsework and the like, following installation.

These known structures have the advantage that they can be formed extremely quickly while, at the same time, they are very reliable, well protected from ground corrosion, adapted to last a long time and to bear the weight of embankments of considerable height and maximum loads envisaged for road and railway works.

However, the main problem common to these known structures is that structures with a span exceeding approximately 15 m cannot be achieved while, at the same time, maintaining the dimensions of the individual prefabricated elements within the shape limits for road transport.

SUMMARY OF THE INVENTION

The structure according to the invention enables spans of approximately 25 m to be obtained, with the dimensions of the individual elements of the structure being within the prescribed shape limit for road transport. In addition, the various elements may advantageously be formed with thinner walls than those of the elements of the known structures, while maintaining the same structural strength.

BRIEF DESCRIPTION OF THE DRAWINGS

Further characteristics and advantages of the present invention will be better understood in the light of the following detailed description, given purely by way of non-limitative example and with reference to the accompanying drawings, in which.

DETAILED DESCRIPTION OF THE INVENTION

Figure 1:
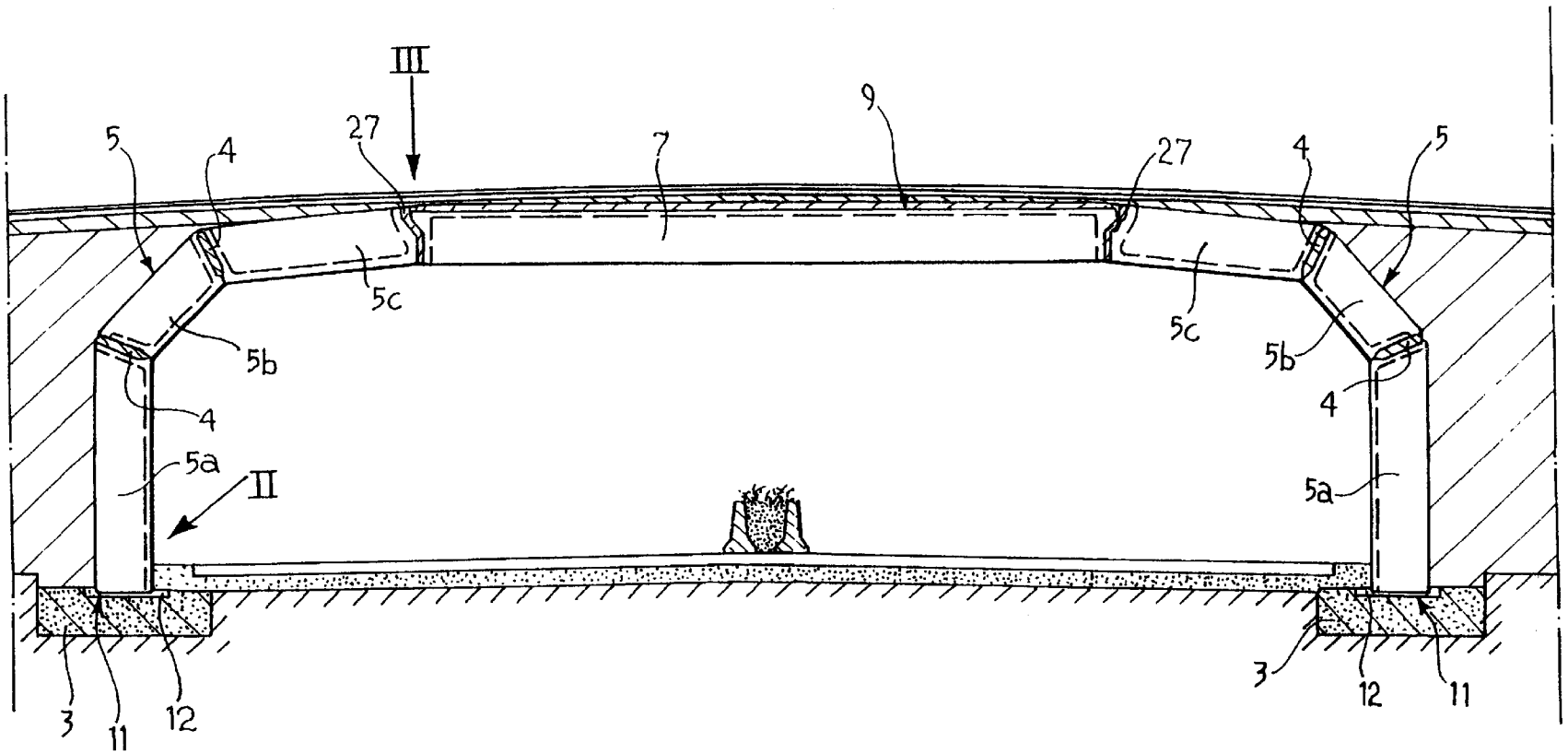
FIG. 1 is a front view of a flyover constructed using a structure according to the invention.

With reference to the drawings, a structure for a motorway flyover constructed using prefabricated elements according to the invention is indicated 1. Naturally, such a structure may advantageously also be used for other similar open air works, for example, underpasses, bridges, tunnels or underground carparks.

The structure 1 includes a plurality of adjacent sections alongside one another, each extending along an axial portion of the work to define a portion of the side walls and the deck 9 of the work. The various sections of the structure 1 rest on a foundation 3 based on an open air excavation and constituted, for example, from two continuous plinths, two concrete girders, or a single platform, or from two piling headers or similar known structures.

Each section of the structure 1 includes a plurality of prefabricated reinforced concrete elements which are first assembled together in their final configuration and then rigidly fixed in this configuration.

Specifically, each section of the structure 1 preferably includes a pair of prefabricated articulated side elements 5, arranged facing one another in a symmetrical position with respect to the axis of the structure, in a substantially inverted L-shaped configuration, and spaced apart rather than being in contact with each other.

Each side element 5 is formed from a first rectilinear body 5*a* defining an upright support of the structure 1, an intermediate rectilinear body 5*b* which cuts off the angle of the L, and another rectilinear bracket-like body 5*c* of substantially constant section. The bodies 5*a*, 5*b* and 5*c* are articulated together at two articulation zones between adjacent bodies, defined by reinforcement rods of the element 5 which are intended to bend during installation. Once installed, concrete is cast into the articulations between the various bodies to form rigidifying casting 4.

Figure 2:
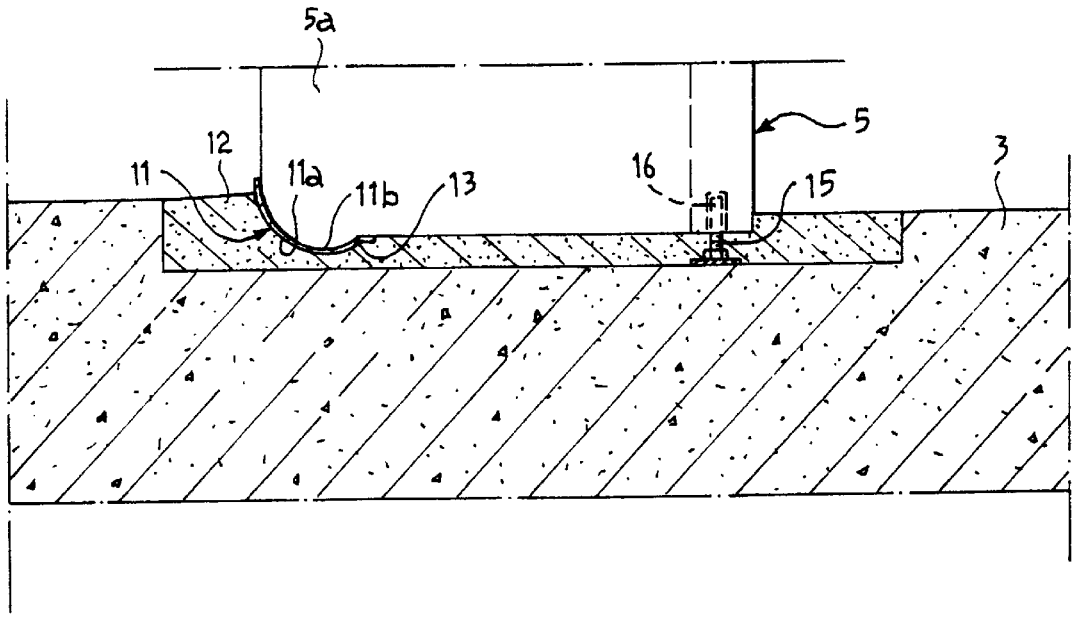
FIG. 2 is a sectional view on an enlarged scale of a detail indicated with the arrow II in FIG. 1.
Figure 3:
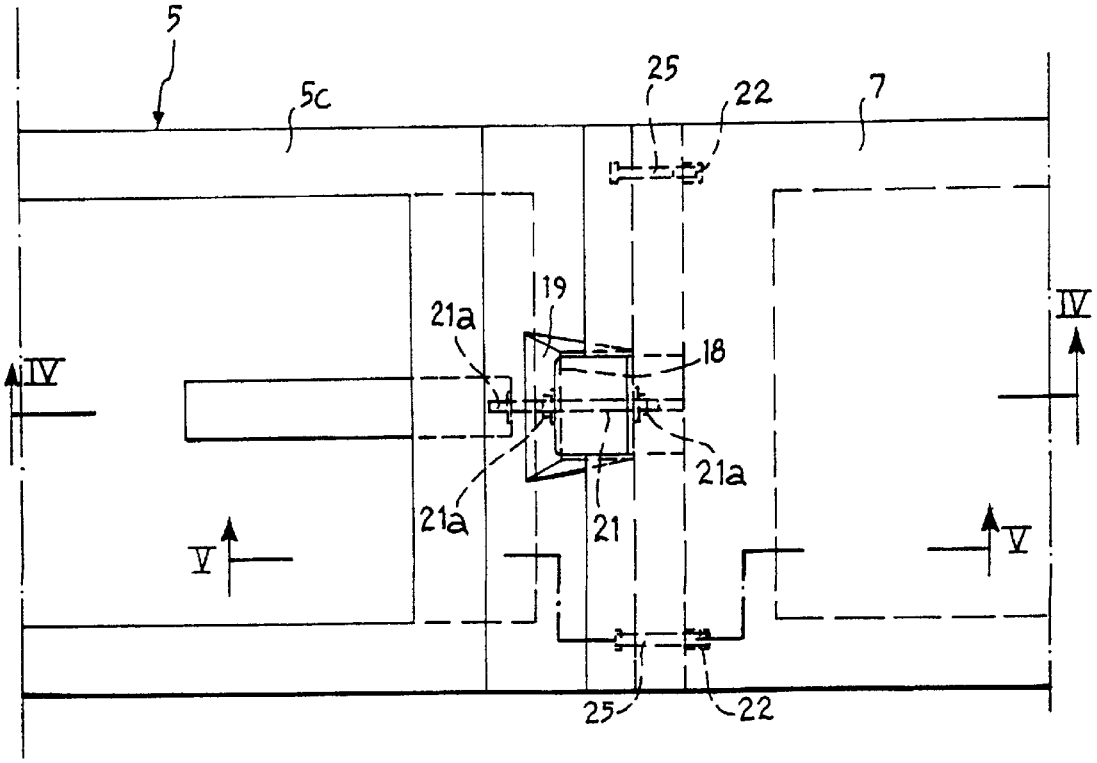
FIG. 3 is an elevational view on an enlarged scale of a detail of a longitudinal portion of the structure indicated with the arrow III in FIG. 1.
Figure 4:
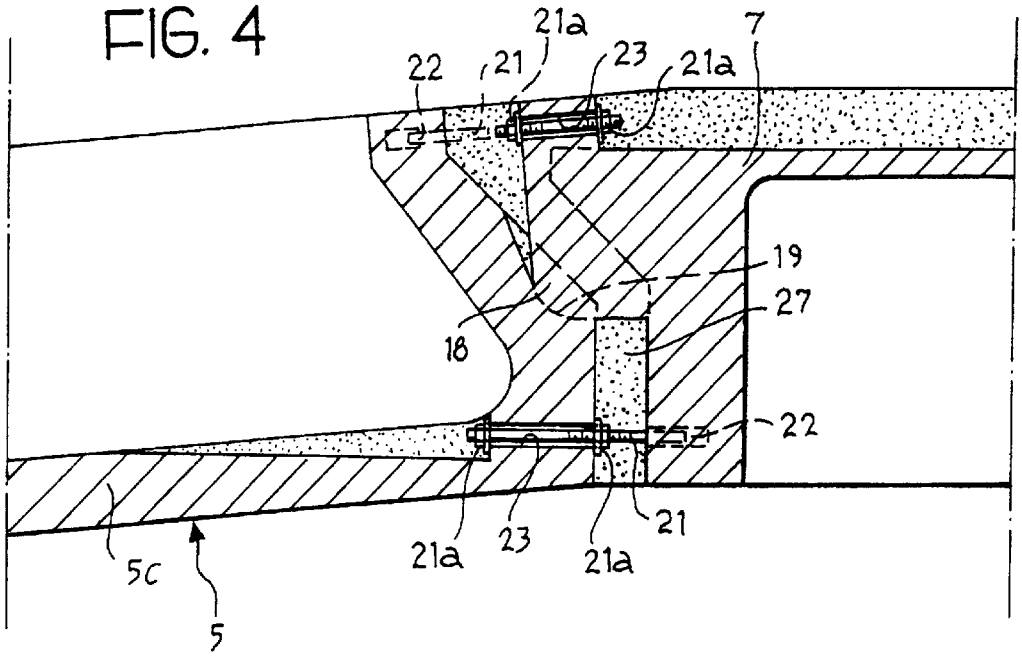
FIGS. 4 and 5 are similar elevational sectional front views taken respectively along the lines IV—IV and V—V of FIG. 3.
Figure 5:
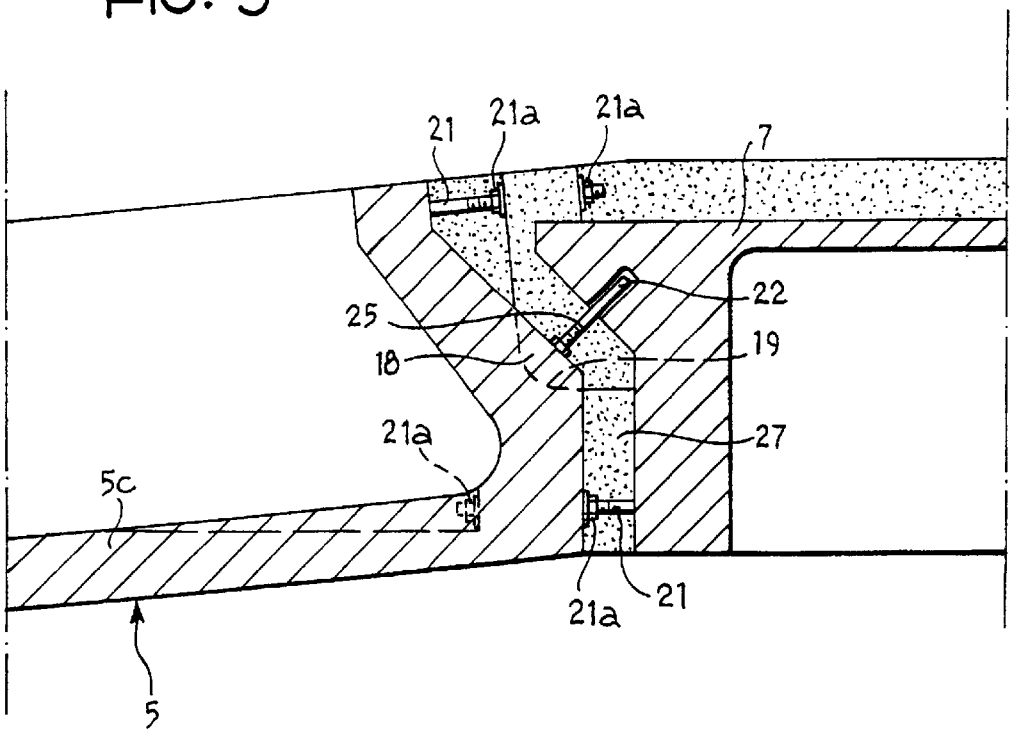
Figure 6:
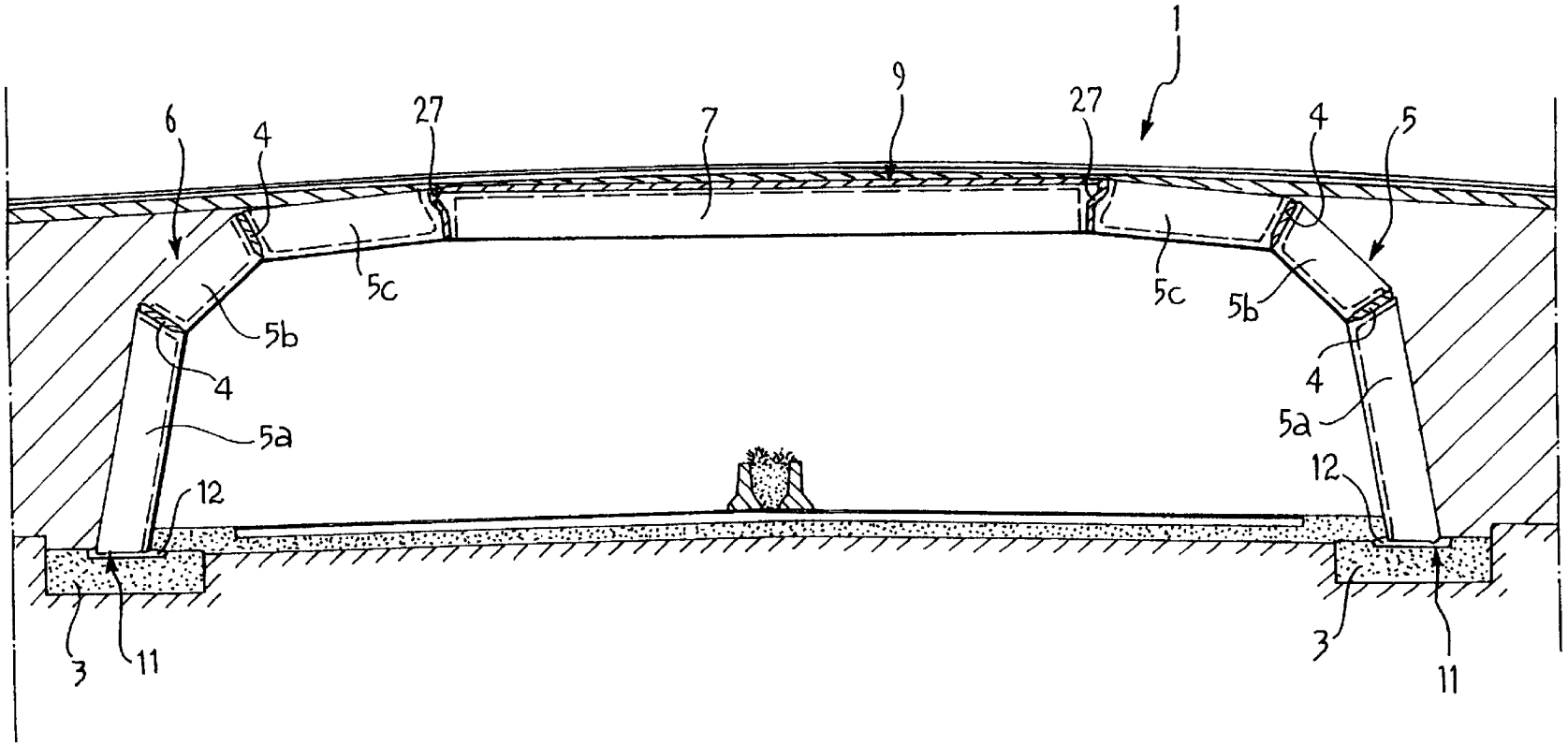
FIG. 6 is a similar view to FIG. 1 of a variant of a motorway flyover constructed using a structure according to the invention.

A respective static hinge 11 is formed between each element 5 and the foundation 3, along the lower edge of the body 5*a* intended to face the exterior of the structure. Each hinge 11 is constituted from a half-portion 11*a* integrally formed as part of the body 5*a* of each element 5, in the form of a projection having a cylindrical outer surface, illustrated in detail in FIG. 2. The other half-portion 11*b* of the hinge 11 is formed in situ after having positioned the element 5 in a hollow seat on the foundation 3, when the concrete 12 is cast between this seat and the element 5. In this way, once the concrete 12 has solidified, it forms the hollow half-portion 11*b* which therefore has a shape which corresponds exactly to the half-portion 11*a*.

In order to assist relative rotation between the half-portions 11*a* and 11*b*, a layer of antifriction material 13 is interposed between them, preferably formed from a sheet of high density polyethylene or other plastics material that is easily deformable and which has a low coefficient of friction in comparison with concrete.

A pair of bushes 16 in which associated support screws 15 engage is incorporated in each body 5*a* close to the projection 11*a*. The heads of the screws 15 rest directly on the foundation 3 in such a way that by adjusting their extension the vertical orientation of the associated element 5 can be controlled. The dimensions of these screws are such that they can support at least the weight of the element 5 while assembling the structure 1 and before the concrete casting 12 has solidified. After the casting 12 has solidified, the weight of the element 5 and the loads thereon are supported by the hinge 11, so that even if the screws 15 were to collapse, the structure would not be affected.

Each body 5*a* is normally intended to be installed vertically. However, where it is desired to space the foundation from a pre-existing site in order to reduce its influence on it during construction, for example, during the construction of flyovers over roads or railways in use, the bodies 5*a* of the elements 5 may be installed in an inclined position with respect to the vertical, for example, at an angle of 0° to 15°, so that the ground-retaining walls of the structure are inclined. If the inclination of these walls gives rise to a larger span solely at the base of the structure, the span at the intrados of the deck 9 remaining the same, the maximum stresses on the structure 1 are reduced. The use of the prefabricated articulated elements makes it very easy to achieve this inclination.

A prefabricated element 7 in the form of a substantially rectilinear beam which defines a central portion of the deck 9 of the work is interposed centrally between a pair of side elements 5. The cross-sectional shape and the disposition of the reinforcement rods of the element 7 are such that it is able to withstand mainly positive bending moments (that is, in the opposite sense from those acting on the elements 5).

The use of prefabricated articulated elements for the side elements 5 enables the joints between the elements 5 and the central element 7 to be located in the best position, that is, where the bending moments of the deck are at their lowest value. If rigid lateral prefabricated elements of similar shape were used instead, there would be the risk of positioning the joints with the central element 7 in positions that are not optimal, or that transporting by road would not be possible as their dimensions would exceed the shape limit for road transport.

In order to facilitate the assembly of the structure 1, each central element 7 is provided with opposing nose-like terminal projections 18 which act as reference members and which extend along its central axis. The projections 18 are intended to engage seats 19 of a corresponding shape having slightly conical walls, formed centrally at the free ends of the bracket bodies 5*c* of the side elements 5.

During the assembly of the structure and, in particular, during the period between the installation of the various prefabricated elements and the formation of the rigidifying castings, the structure 1 has the form of a static articulated quadrilateral, which means it is unstable. In fact, the structure 1 is formed from three substantially rigid elements, in particular, two elements 5 (the articulations of which do not in this state act as hinges since they tend to remain always bent into an L-shape due to the loads applied) and an element 7, joined together by two hinges interposed in the joints between them, and with two further hinges disposed between the elements 5 and the foundation 3.

To obtain stability of the structure 1 in these conditions the two side elements 5 and the central element 7 must be fixed together. This does not require very strong means as the structure is already balanced with respect to all of the symmetrical loads acting on it. However, unbalancing bending moments caused by possible asymmetric loads may arise in the structure due, for example, to partially completed in situ casting, or accidental movement caused by mobile construction site loads or by the lateral wind pressure, which is generally less than that of the symmetrical loads. In any case, it is desired to achieve the stability of the structure 1 without having to rely on auxiliary temporary shoring installed before the rigidifying castings.

One way of achieving this end is by fixing the elements 5 and 7 together by means of coupling devices of the screw and nut type. In particular, a pair of threaded bushes 22 is incorporated at the ends of the central element 7, below the projections 18, in which engage respective screws 21 intended to pass through through-holes 23 formed in corresponding positions in the bodies 5*c* of the side elements 5.

Similarly, a further threaded bush 22 is incorporated in each body 5*c* above the seat 19, engaged by a screw 21 disposed so as to be able to pass through an associated through-hole 23 formed in a corresponding position at an end of the element 7. Pairs of locking nuts 21*a* enable each screw 21 to be fixed with respect to the ends of the through-holes 23. In addition, a pair of screws 25 extends from associated threaded bushes 22 embedded in the element 7 at the sides of each projection 18, with heads able to abut against an inclined surface of each free end of the bodies 5*c*.

In this way, by controlling the extension of the screws 21 and 23, the desired balanced connection between the elements 5 and 7 can be obtained.

As an alternative to the screw and nut coupling devices, portions of reinforcement rods projecting from the opposite ends of the elements 5 and 7 may be used to join them together, so as to fix these elements in a balanced position.

During the assembly of the structure, after having placed the two elements 5 at a mutual distance slightly greater than the distance between the ends of the nose-like projections 18 of the central element 7, it is advisable to utilise temporary adjustable support devices, for example, hydraulic jacks (not illustrated in the drawings) to hold them temporarily in position. Then, the central element 7 is positioned between them such that the projections 18 engage the associated seats 19.

After lowering the temporary supports, the projections 18 are disposed on the bottom of the seats 19. The positioning of the central element 7 is completed by adjusting the screws 21 and 23 so as to prevent it from rotating about a horizontal axis perpendicular to the axis of the structure, and stabilise the articulated quadilateral structure.

When the balanced assembled condition of the structure 1 has been achieved, the elements 5 and 7 are anchored together and to the adjacent sections of the structure by means of rigidifying castings 27 formed in situ.

The resistance of the work, at the joints between the elements 5 and 7, against positive bending moments is easily guaranteed by reinforcements inserted in the lower part of the rectilinear joint which extends both between adjacent central elements 7 and between adjacent side elements 5; the resistance against negative bending moments is guaranteed by reinforcements inserted in the casting of the completion slab formed above the deck 9, and resistance against shear forces is guaranteed by reinforcements inserted between each element 7 and the associated pair of side elements 5.

With the joints of the structure being fixed in this way, it assumes the static outline of an arch having two hinges at the base, which therefore has a degree of hyperstaticity. Notwithstanding that, it may appear, due to its hyperstaticity, that the structure 1 is subject to stress states following the subsidence of one of its ties, as opposed to what occurs in the three-hinged arch structures, it is in fact particularly adapted to withstand subsidence of the foundation plinth without damage. In fact, possible vertical subsidence of a plinth, which is the most common direction for subsidence as it corresponds with the direction of the ground reaction, does not give rise to stresses in the structure as it causes practically no change in the distance between the two support hinges. Therefore, the structure according to the invention acts in a similar way to the three-hinge arch when faced with this kind of subsidence. Only the displacement of one plinth with respect to the other in the horizontal direction is able to give rise to forces that may damage the structure. But these displacements occur only if significant horizontal forces act on the plinths such as to overcome the frictional resistance of the ground beneath them. However, for the typical dimensions and loads intended for these structures (spans between approximately 10 and 25 m, heights between 3 and 6 m, with a ratio between span and height of approximately 3–4 for flyovers, subways or underground carparks, and a ratio of approximately 1.5–2 for artificial tunnels and other deep underground structures), the resulting forces which act on the plinths are practically vertical and so the residual horizontal component acting on the plinths is small and does not therefore tend to generate significant movements. In addition, as the rigidity of the structure against these deformations is relatively low, the possible forces induced would be fairly modest.

This structure has many other advantages compared to the three-hinge arch structures.

First, it may be formed with much thinner walls, as the maximum bending moment caused by the loads which bear on the slab or deck is substantially divided between embedded end moments and middle moments, and is thus approximately one third of that of the simply supported beams usually used for forming the deck (the presence of the inclinations has already reduced it from half to approximately ⅓), and approximately half of the maximum of the prefabricated three-hinge arch structure described in the European Patent mentioned above.

The reduction in thickness of the walls significantly reduces the cost of the entire structure and increases its torsional deformability thereby making it more able, even more than the three-hinge arch structures, to resist breaking upon twisting, or differential, subsidence of the foundation plinths, that is, subsidence which has the effect that the two base position hinges are no longer coplanar, that is, not on the same horizontal plane.

This twisting subsidence is among the most frequent and damaging in that it arises when the ground below part of one of the two plinths has a low load-bearing capacity. In this case, the structure is stressed by the loads following subsidence of the plinths, and deforms due to twisting. The tensions induced in the structure are less the smaller is its torsional rigidity and thus the thickness of its walls. In this way the two-hinge arch structure is better able to withstand these deformations than the three-hinge arch structure in that this latter, for the same external loads, requires larger sections that are therefore less able to twist.

Finally, a particularly interesting advantage of the structure according to the invention is due to the fact that the dimensions of its elements are within the shape limits for road transport even for structures having spans much greater than that which are possible with road-transportable three-hinge arch structures. In practice, the entire length of the central element 7 is caught within the maximum span so that from a maximum span of approximately 14–15 m, typical of the three-hinge arch structures, a maximum span of up to approximately 25 m may be achieved.

In addition, in the structures according to the invention, as occurs already in the case of the three-hinge arch, there is no need for an expansion joint between the deck and the uprights as the thermal expansion of the deck is absorbed very well by the entire structure with a slight raising of the central part of the deck, and with forces that are almost negligible with respect to the axial rigidity of the deck in the direction of the span of the bridge. The significant practical advantage thus arises that, in the absence of expansion joints, the seal of the work along the deck is improved and maintenance operations, which are frequent when such joints are present, are not necessary. They are onerous and troublesome for road traffic.

What is claimed is:

1. A prefabricated structure for constructing an open air work including a plurality of prefabricated elements (5,7) formed from reinforced concrete forming side walls and a deck (9) of the work with adjacent longitudinal sections of the structure (1) intended to rest on a foundation (3) formed at a base of the work, wherein each part of the structure (1) includes a pair of prefabricated side elements (5) which rest on the foundation (3) through an associated hinge connection (11), and are intended to be disposed symmetrically with respect to an axis of the work so as to assume a substantially L-shape configuration in an installed condition and a substantially rectilinear prefabricated central element (7) interposed centrally between two side elements (5) and anchored thereto to define a central portion of the deck (9) of the work.

2. A structure according to claim 1, wherein each side element (5) includes three rectilinear bodies (5*a*, 5*b*, 5*c*) of which a first end body (5*a*) defines an upright of the structure (1), an intermediate body (5*b*) defines an inclined part, and a second end body (5*c*) defines a bracket, said bodies (5*a*, 5*b*, 5*c*) being adapted to be articulated together between a prefabrication stage and a final positioning stage by bending reinforcement rods of the element (5) which extend between adjacent bodies.

3. A structure according to claim 2, wherein each first end body (5*a*) of each side element (5) is intended to be installed in a position inclined with respect to a vertical plane at an angle of less than approximately 15°.

4. A structure according to claim 2, wherein each of the said first end bodies (5*a*) includes a projection (11*a*) defined by a cylindrical surface and intended to constitute a half-portion of the said hinge connection (11).

5. A structure according to claim 4, wherein each of the said first end bodies (5*a*) includes a projection (11*a*) defined by a cylindrical surface and intended to constitute a half-portion of the said hinge connection (11).

6. A structure according to claim 5, wherein a layer of antifriction plastics material (13) is interposed between said half-portions (11*a*, 11*b*) of each hinge connection (11).

7. A structure according to claim 5, wherein close to the projection (11*a*) of said first end bodies (5*a*) there are adjustable support means (15, 16) able to support at least weight of the associated side element (5) during assembly of the structure (1) and before the hollow half-portion (11*b*) of the associated hinge connection (11) is operative.

8. A structure according to claim 7, wherein reinforcing rods positioned in situ in joints between several side elements and central element of adjacent sections (1) of the structure are incorporated in the rigidifying castings (27) which anchor a central element (7) and a pair of side elements (5) together.

9. A structure according to claim 1, wherein the side elements (5) and/or the central element (7) are provided with reference and mutual retention means (18, 19, 21, 21*a*, 22, 23, 25) for fixing the side elements and the central elements together before anchoring the side elements and the central elements by means of a rigidifying casting (27).

10. A structure according to claim 9, wherein the central element is provided with opposite nose-like end projections (18) which extend along a central axis and are intended to engage associated seats (19) formed at free ends brackets bodies (5*c*) of the side elements (5).

11. A structure according to claim 10, wherein the central element (7) and/or the side elements (5) are provided with adjustable screw members (21, 25) for mutual connection, these being connected to one of these elements and cooperating with the other of these elements so as to enable the central element (7) to be fixed to the side elements (5) during the assembly of the structure (1).

* * * * *

UNITED STATES PATENT AND TRADEMARK OFFICE

CERTIFICATE OF CORRECTION

PATENT NO. : 6,129,484
DATED : October 10, 2000
INVENTOR(S) : Carlo Chiaves

It is certified that error appears in the above-identified patent and that said Letters Patent is hereby corrected as shown below:

Title page,
Item No. [22], PCT Filing Date, delete "November 17, 1996" insert -- November 14, 1996 --.

Signed and Sealed this

Thirtieth Day of October, 2001

*Attest:*

Nicholas P. Godici

NICHOLAS P. GODICI
*Acting Director of the United States Patent and Trademark Office*

*Attesting Officer*